US006623287B2

(12) United States Patent
Hatagishi et al.

(10) Patent No.: US 6,623,287 B2
(45) Date of Patent: Sep. 23, 2003

(54) LEVER-JOINT CONNECTOR

(75) Inventors: Yuji Hatagishi, Shizuoka (JP); Naotoshi Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/244,388

(22) Filed: Sep. 17, 2002

(65) Prior Publication Data

US 2003/0054681 A1 Mar. 20, 2003

(30) Foreign Application Priority Data

Sep. 19, 2001 (JP) ..... 2001-284496

(51) Int. Cl.[7] ..... H01R 13/62
(52) U.S. Cl. ..... 439/157; 439/352
(58) Field of Search ..... 439/152, 153, 439/157, 160, 372, 352

(56) References Cited

U.S. PATENT DOCUMENTS 5,344,194 A * 9/1994 Hatagishi et al. ..... 285/26
5,797,758 A * 8/1998 Tsuchiya et al. ..... 439/157
6,012,933 A * 1/2000 Katsuma ..... 439/157
6,241,540 B1 * 6/2001 Tokuwa ..... 439/157
6,517,364 B2 * 2/2003 Muramatsu et al. ..... 439/157

FOREIGN PATENT DOCUMENTS

JP 2-278674 11/1990

* cited by examiner

*Primary Examiner*—Lynn Feild
*Assistant Examiner*—Thanh-Tam Le
(74) *Attorney, Agent, or Firm*—Armstrong, Westerman & Hattori, LLP

(57) ABSTRACT

Locking and unlocking a lever and the both connectors effectively, a lever-joint connector includes one connector 1 having a lever 4 and the other connector 29 having a follower portion engaging slidably with the lever, providing a first locking portion 5 and a pushing portion 6 on the lever 4, providing a first be-locked portion 7 and a second locking portion 9 having a be-pushed portion 28 on the one connector 1, providing a second be-locked portion 30 on the other connector 29, pushing the be-pushed portion 28 during the lever 4 turns by means of the pushing portion 6 to turn the second locking portion 9 for unlocking the second be-locked portion 30.

7 Claims, 5 Drawing Sheets

LEVER-JOINT CONNECTOR

BACKGROUND OF THE INVENTION

1. Field of the Invention

This invention relates to a lever-joint connector, in which a male and a female connectors are jointed with low force and the both connectors and the lever is locked by means of turning a lever.

2. Description of the Related Art

Currently, a connector using a lever to reduce jointing force is applied for jointing easily a male and female connectors having a lot of terminals.

For example, mounting a lever rotatably on a female connector, providing a locking device on the lever and a male connector, the lever and the male connector are locked by means of locking of the locking devices when the connectors are jointed so that the lever and the connectors are locked.

When an external strong force may break the lever in such lever-joint connector, the locking for the both connectors is damaged and the male and female connectors may be separated to disconnect electrical connecting.

To overcome the above drawback, lock mechanisms for a lever and a male and female connectors are provided separately for improving reliability of connecting. A lock-type connector shown in FIG. 12 is proposed (refer Japanese Patent Application No. H2-278674).

In the lock-type connector 51, a lever 54 having a locking projection 53 is provided rotatably on a female connector 52, and an engaging projection 56 corresponding to the locking projection 53 and a flexible lock arm 57 corresponding to the female connector 52 are provided on a male connector 55 for locking the lever 54 and locking connectors 52, 55 mutually separately.

The lever 54 has a cam groove 58, and the male connector 55 has a projected follower shaft 59 for engaging with the cam groove 58, and the female connector 52 has a slit portion 60 corresponding to the follower shaft 59 in a direction of jointing a connector. The lock arm 57 has a locking projection 61, and the female connector 52 has an engaging concave portion 62 corresponding to the locking projection 61.

Jointing the follower shaft 59 in the slit portion 60, and turning the lever 54 toward near-side, the follower shaft 59 is engaged with the cam groove 58 and pulled along the cam groove 58 in a direction of jointing a connector. Thereby, the male/female connectors 55, 52 are jointed, and locking of the lever 54 and the both connectors 55, 52 are done simultaneously.

In this specification, a connector having a connector receiving section 63 is defined as the female connector 52 and a connector inserted into the connector receiving section 63 is defined as the male connector 55. A plurality of male terminals joined to electric wires are inserted and locked in the female connector 52 and a plurality of female terminals joined to electric wires are inserted and locked in the male connector 55. The male and female terminals (not shown) are connected at the same time when the male and female connectors 55, 52 are jointed.

OBJECTS TO BE SOLVED

Regarding the lever-joint connector 51 by prior art, as mentioned above, when jointing the connectors, the locking projection 61 of the lock arm 57 abuts on a front end of the female connector 52 and thereby the lock arm 57 is deflected so that jointing force of the connectors may be increased. When separating the male and female connectors 55, 52 after jointing the connectors, operations of deflecting the lock arm 57 to unlock the lock arm 57, keeping the condition, and turning the lever 54 toward far-side to unlock the lever 54 are required so that unlock operation, i.e. operation for separating connectors is troublesome.

To overcome the above drawback of prior art, one object of this invention is to provide a lever-joint connector in which operating force for jointing connectors and locking connectors is reduced and jointing, separating, and locking and unlocking of a lever and connectors can be done easily and effectively.

SUMMARY OF THE INVENTION

HOW TO ATTAIN THE OBJECT

In order to attain the objects, a lever-joint connector, according to this invention, includes one half of the connector provided with a freely rotatable lever and the other half of the connector provided with a follower portion to be engaged slidably with the lever, providing a first locking portion and a pushing portion on the lever, providing a first be-locked portion to be locked by the first locking portion and a second locking portion having a be-pushed portion to be pushed by the pushing portion on the one half of the connector, providing a second be-locked portion to be locked by the second locking portion on the other half of the connector, pushing the be-pushed portion during the turn of the lever by means of the pushing portion to turn the second locking portion in a direction of unlocking it from the unlocking with the second be-locked portion.

In the above structure, turning the lever toward a direction for jointing connectors (toward near-side), the other half of the connector together with the follower portion is pulled toward the one half of the connector and the pushing portion of the lever pushes the be-pushed portion of the second locking portion to turn the second locking portion in a direction of unlocking, and the second locking portion is positioned on the second locked portion without contacting or with contacting by a small contacting force, and the pushing portion goes out of the be-pushed portion accompanying with rotation of the lever and engages with the second be-locked portion simultaneously with complete jointing of the connectors, and the both connectors are locked and simultaneously the first locking portion engages with the first be-locked portion to lock the lever. Thus, locking of the lever and the male and female connectors can be done by means of turning only the lever. The second locking portion does not abut on the second be-locked portion so that jointing and locking connectors can be done smoothly by a small force.

Thereafter, for separating the connectors, turning the lever toward a direction for separating (far-side) while unlocking the first locking portion from the first be-locked portion, the pushing portion of the lever pushes the be-pushed portion of the second locking portion to turn the second locking portion for unlocking, and thereby, the second locking portion and the second be-locked portion of the other half of the connector is unlocked. Unlocking the first locking portion of the lever and turning lever, i. e. unlocking the both connectors can be done once by the same finger.

The lever-joint connector, as mentioned above, has an insert portion for inserting the pushing portion, adjacently to the be-pushed portion, on the second locking portion.

In the above structure, when jointing the connector, the pushing portion of the lever goes through the be-pushed portion of the second locking portion into the adjacent insert portion, and thereby, pushing by the pushing portion is released and the second locking portion returns to a direction of locking to engage with the second be-locked portion of the other half of the connector. When separating the connectors, the pushing portion of the lever goes out of the insert portion to push the be-pushed portion so that engagement of the second locking portion and the second be-locked portion is disengaged.

In the lever-joint connector, as mentioned above, the first locking portion is a flexible first locking arm mounted at a front end of the lever.

In the above structure, while deflecting the first locking arm toward far-side for unlocking, the lever can be turned toward far-side so that the jointed connectors can be separated easily.

In the lever-joint connector, as mentioned above, the second locking portion is a teeter type second locking arm, and the second locking arm is provided, at a front end thereof, with a locking portion corresponding to the second be-locked portion and at a rear end thereof, with the be-pushed portion, and the second locking arm is energized at a front thereof downward in a free condition.

In the above structure, the be-pushed portion at a rear side of the second locking arm is at a high position in a free condition, and abuts on the pushing portion when the lever turns forward, and is made down securely, and simultaneously the locking portion at a front side thereof is pushed up, and then the second locking arm is turned securely in a direction of unlocking. When the be-locked portion engages with the locking portion, the locking portion is energized elastically to a direction of locking the be-locked portion (downward), so that reliability of locking is improved.

In the lever-joint connector, as mentioned above, the pushing portion is a plate-like fin portion extending downward from the lever and the insert portion for the pushing portion is a groove along lengthwise of the second locking portion.

In the above structure, the plate-like fin portion does not require wide width, and then the structure can be miniaturized and the fin portion can enter smoothly the groove of the second locking portion and engage with the groove so that the second locking portion is made stable widthwise. Thereby, position of the fin portion, i.e. position of the lever, is restrained widthwise so that the first locking portion can engage securely with the first be-locked portion without position error.

In the lever-joint connector, as mentioned above, the pushing portion is provided behind the first locking portion and on an axis of the widthwise center line of the first locking portion.

In the above structure, the second locking portion, the pushing portion and the first locking portion are located on the same vertical plane so that the structure is miniaturized widthwise.

In the lever-joint connector, as mentioned above, the second locking portion is located inside a frame-like wall which constitutes the first be-locked portion.

In the above structure, the second locking portion surrounded by the frame-like wall is protected from actions of outside. Thereby, unexpected unlocking or breakage of the second locking portion is prevented.

The above and other objects and features of this invention will become more apparent from the following description taken in conjunction with the accompanying drawings.

DESCRIPTION OF THE PREFERRED EMBODIMENT

Figure 2:
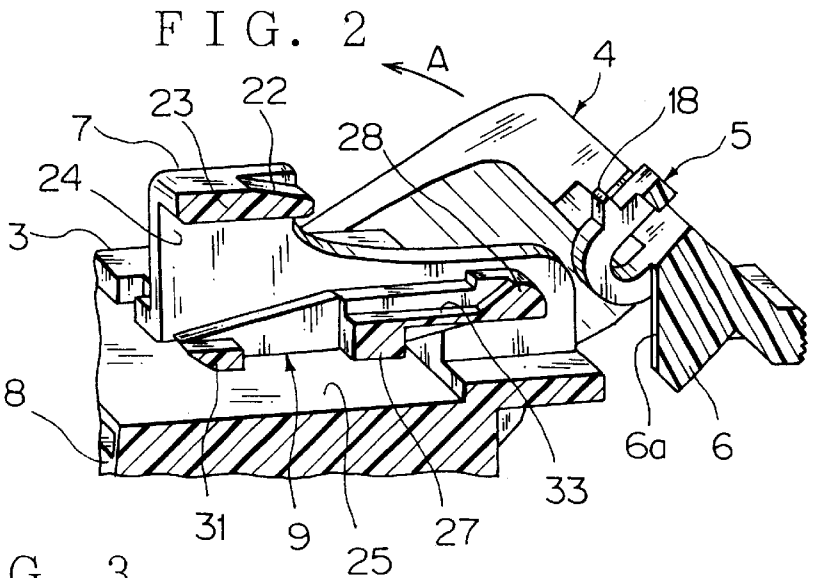
FIG. 2 is a perspective view, showing a main area of a locking mechanism of the male connector in FIG. 1.
Figure 3:
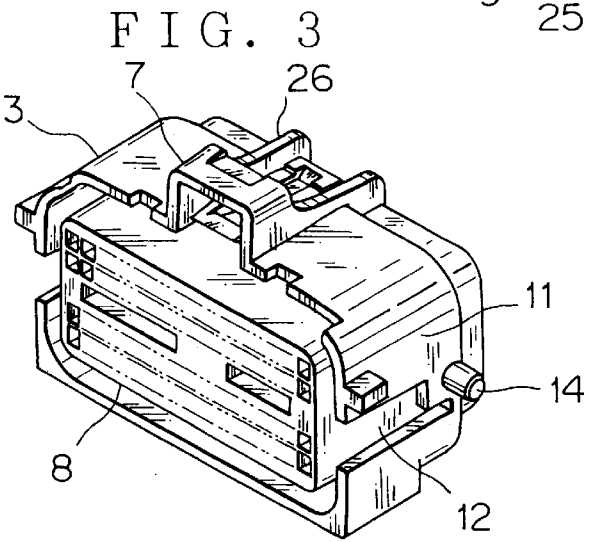
FIG. 3 is a perspective view of the male connector in which a lever is removed.
Figure 1:
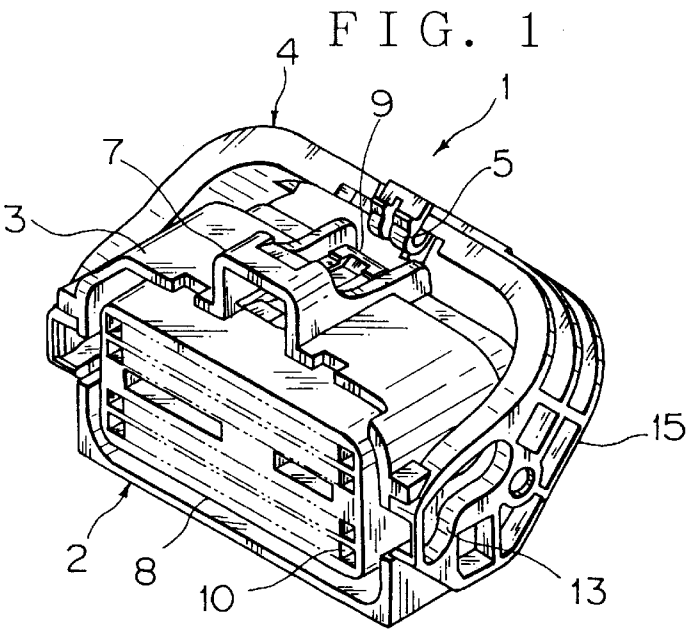
FIG. 1 is a perspective view of one embodiment of a male connector in a lever-joint connector according to this invention.

An embodiment according to this invention will now be described with reference to drawings. FIG. 1–3 show an embodiment of a male connector of a lever-joint connector, according to this invention.

A male connector 1 includes a connector housing 2, made of a synthetic resin, having a lever 4 rotatably on a hood 3 made of a synthetic resin; the lever provided integrally with a flexible first locking arm 5 (locking portion) and a fin portion 6 (FIG. 2) for pushing (pushing portion); the hood 3 provided integrally with a frame wall 7 for locking (a first be-locked portion) corresponding to the first locking arm 5; and a housing body 8 of the connector housing 2 inside the frame wall 7 provided integrally with a teeter type second locking arm 9 (locking portion, FIG. 2), an end of which can be pushed by the fin portion 6; and the lever 4 is locked by the first locking arm 5, and the male and female connectors are locked by the second locking arm 9, and the second locking arm 9 is pushed and turned for unlocking by the fin portion 6 while turning the lever 4.

The connector housing 2, as shown in FIG. 1, is structured with the outer hood 3 and the housing body 8, formed integrally inside the hood 3, having a plurality of terminal receiving sections 10. A female terminal (not shown) with an electric wire is inserted into the terminal receiving section 10 from the back and is locked by means of a flexible locking lance (not shown) in the terminal receiving section for preventing from extracting backward. The lever 4 with U-shape is supported rotatably by shafts on right/left sides of the hood 3.

The lever 4 is removable from the hood 3, as shown in FIG. 3. Slit portions 12 are formed along a direction of jointing connectors (horizontal direction) on the both side walls 11 of hood 3 and cam openings 13 (cam portions) are provided to communicate to the slit portions 12 at the both sides of the lever 4. The slit portions 12 and the cam openings 13 are for guiding a follower shafts (follower portions) of the female connector.

A direction of jointing a connector is defined as forward and a direction of separating a connector is defined as rearward. A shaft 14 for supporting the lever 4, as shown in FIG. 3, projects from the hood 3 rearward the slit portion 12. The both side walls 15 of the lever 4 (FIG. 1) are deflectable outward and can be removed easily from the shaft 14 so that if lever operation (low jointing force) is not required, the lever 4 can be removed in use, as shown in FIG. 3.

Figure 4:
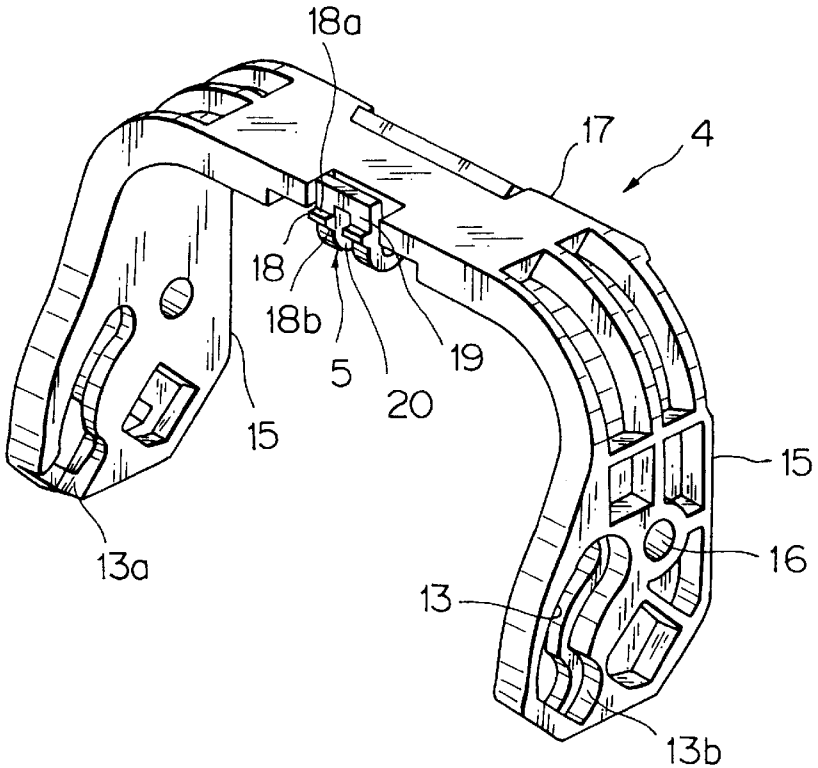
FIG. 4 is a perspective view of the lever, viewing from the front.

The both side walls 15 of the lever, as shown in FIG. 4 (a perspective view of the lever 4 in front), are provided, adjacently to rear side of top ends of the cam openings 13, with openings 16 for inserting respectively the shafts 14 (FIG. 3) therein. The cam opening 13 extends along lengthwise of a side portion of the lever 4 (in a vertical direction) and curves rearward in arc shape. A part of a bottom end of the cam opening 13 is opened outward to insert the follower shaft of the female connector (FIG. 9) from a bottom opening 13*a* into the cam opening 13. The cam opening 13 is stepped in a direction of thickness of the lever 4 to engage a disk head of the follower shaft (FIG. 9) with an outer wide width portion 13*b*. When operating the lever 4, the cam opening 13 turns around the opening (shaft) 16 (14) and the follower shaft is guided gradually in a direction of jointing connectors from the bottom opening 13*a* far from the opening 16 to be close to the center of turning.

The first locking arm 5 is formed at a front end of an operation plate portion 17 in the center of the lever 4, as shown in FIGS. 2, 4. The first locking arm 5 is curved in U-shape or J-shape and one end thereof is perpendicularly continuous to the operation plate portion 17 and the other end thereof (free end) projects forward of the operation plate portion 17. A locking projection 18 (locking portion) is formed integrally at a front surface of the other end thereof. The locking projection 18 is located in a lengthwise middle of a straight portion 19 of the other end and a top end of the straight portion 19 extends on an upper side of the locking projection 18 as an operating portion for unlocking. The locking projection 18 has a horizontal locking surface 18*a* facing upward and a slant surface 18*b* facing downward (upward/downward is defined at vertically standing lever 4). The first locking arm 5 has a slit 20 at the widthwise center thereof and a pair of locking projections 18 are provided respectively at right and left sides of the slit 20.

Figure 5:
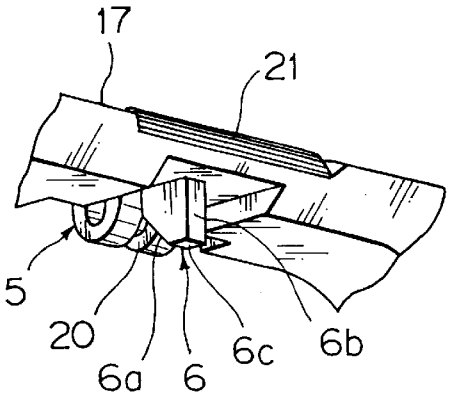
FIG. 5 is a perspective view of a locking portion of the lever, viewing from the rear.

The fin portion 6 is located rearward the slit 20 as shown in FIGS. 2 and 5 (rear view of the lever). The slit 20 is a die forming opening for molding the fin portion 6. The fin portion 6 projects from a bottom surface (inner surface) of the operating plate portion 6 and is located rearward in a widthwise center of the first locking arm 5. The fin portion 6 has a projecting height as same as or larger than a height of the first locking arm 5. The fin portion 6 is formed into a triangle plate with a slant surface 6*a* at front side, a vertical surface 6*b* (perpendicular to the operating plate portion 17) at rear side and a horizontal surface 6*c* at edge end (bottom end). The operating plate portion 17 extends to rearward of the vertical surface 6*b* at rear side of the fin portion 6 and an extended portion thereof, i.e. a rear end portion of the operating plate portion 17, is formed with a triangle-cross-sectional operating portion 21 having a non-slip.

The U-shaped frame wall 7 is formed by means of projecting on the top wall of the hood 3 as shown in FIG. 1, 2 and 6–8. The frame wall 7 is formed, on an upper surface of a wall 23 (FIG. 2) at a top side thereof, with a slant surface 22 (FIG. 2) for sliding a slant surface 18*b* of the locking projection 18 in the first locking arm 5 to engage the locking surface 18*a* of the locking projection 18 with an inner surface (bottom surface) of the wall 23.

Turning the lever 4 along an arrow A from tilting backward condition toward vertical standing condition for jointing connectors as shown in FIG. 2, the slant surface 18*b* of the locking projection 18 slides on the slant surface 22 of the top side wall 23 just before a standing position and the locking arm 5 deflects backward, and the locking projection 18 goes over the top side wall 23 to enter under the wall 23 for engaging, and the locking surface 18*a* of the locking projection 18 abuts on the bottom surface of the wall 23. Thereby, the lever 4 is locked with the frame wall 7 and prevented from going back. Therefore, loosing of connection of the connectors by means of clearance of the lever 4 or separating of the mating female connector can be prevented.

Walls 24 at both sides of the frame wall 7 extend perpendicularly to the top wall 25 of the housing body 8 integrally, and extend continuously rearward in low height, and these extending portions 26 (FIG. 3) extend to a rear end of the housing body 8. The top wall 25 of the housing body 8 appearing under the frame wall 7 is provided with a second locking arm 9 (locking portion). The extending portions 26 at the both sides of the frame walls 7 is higher than the second locking arm 9 to protect the second locking arm 9 from interaction of outside.

The second locking arm 9 extends in a direction of jointing connectors, and is supported at a lengthwise middle portion thereof by means of one piece low profile post portion 27 (FIG. 2) to rock up-and-down like a teeter-totter. A rear end of the second locking arm 9 is located higher in a vertical direction than a front end thereof at free condition. An upward projection 28 (be-pushed portion) for being pushed is provided at the rear end of the second locking arm 9, and a locking portion 31 corresponding to an engaging projection 30 (the second be-locked portion) of the mating female connector 29 is provided at the front end of the second locking arm 9. A room 32 for receiving and engaging the engaging projection 30 is provided adjacently to rear side of the locking portion 31. A groove 33 for receiving deeply the front end 6*c* of the fin portion 6 is provided along lengthwise of the arm between the be-pushed projection 28 at rear end and the post portion 27.

As another example, the second locking arm 9 is provided, at forward and rearward of the post portion 27 in the widthwise center, with a slit forming a front side room 32 (FIG. 6) and a rear side groove 33. The slit may extend from a position just before the locking portion 31 at a front end to a position just before the be-pushed projection 28 at rear end. A slit opening through up and down may be used instead of the groove 33.

Figure 6:
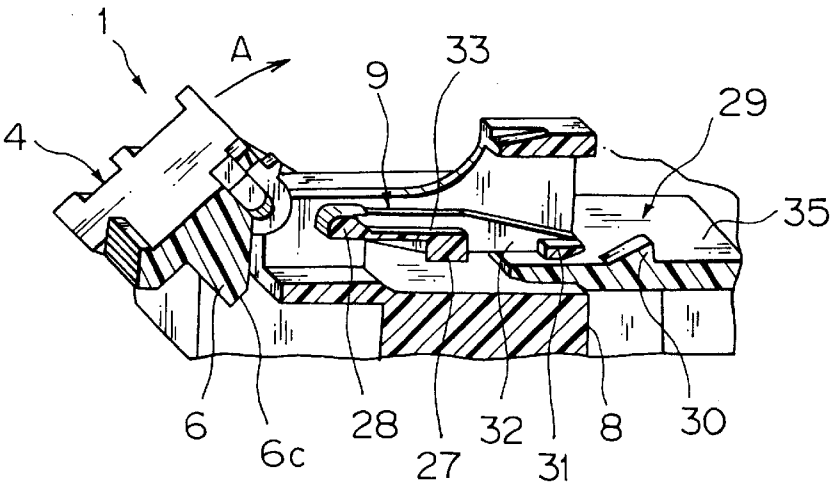
FIG. 6 is a perspective view, showing a main area of the locking mechanism when initially jointing the male and female connectors.
Figure 10:
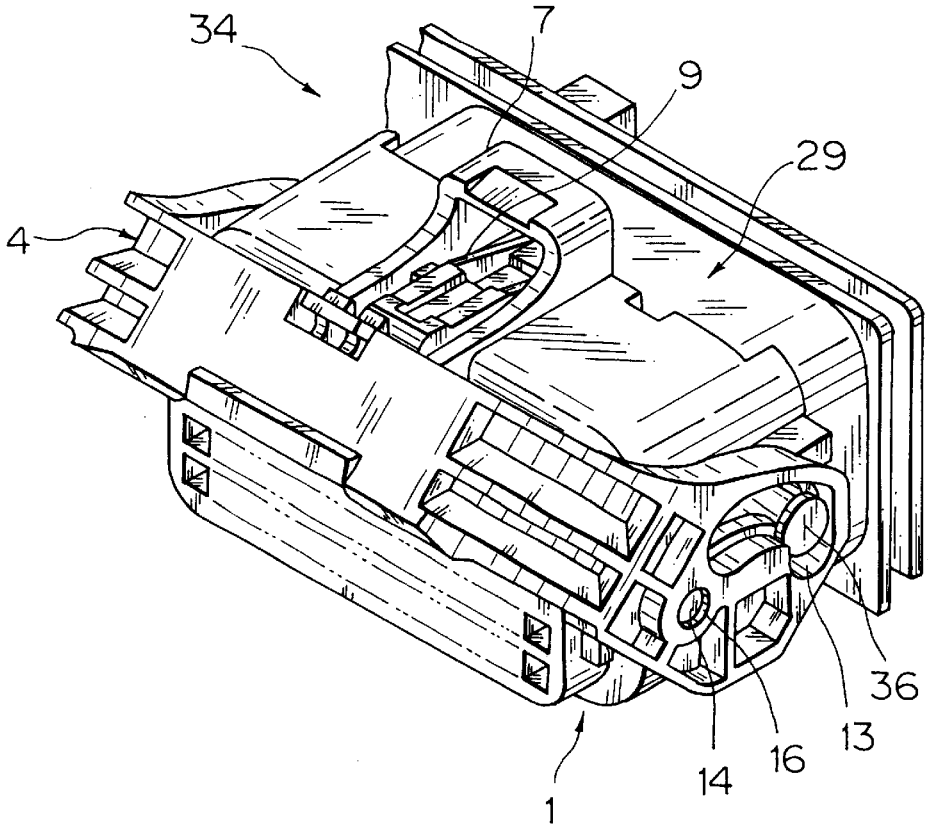
FIG. 10 is a perspective view, showing a condition of initially jointing the male and female connectors.

To joint a male and female connectors 1 and 29, initially jointing the both connectors 1, 29 (jointing the both connectors slightly by manual) as shown in FIG. 6, the lever 4 is turned forward from rear side along an arrow A. The male and female connectors form a lever-joint connector 34 (FIG. 10).

In the initial jointing of FIG. 6, the lever 4 is located slantwise at rearward of the second locking arm 9. The engaging projection 30 of the female connector 29 is positioned oppositely against the second locking arm 9 at slightly forward position of the second locking arm 9. The front end of the female connector housing 35 is under the front end of the second locking arm 9, and the front end of the housing body 8 of the male connector 1 goes in inside of the female connector housing 35.

Figure 7:
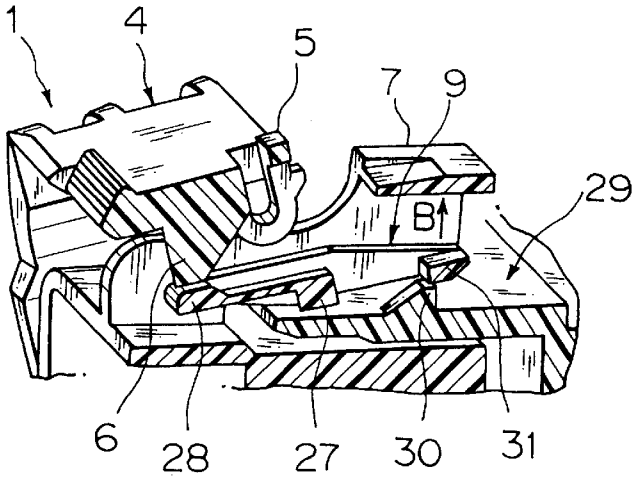
FIG. 7 is a perspective view, showing a main area of the locking mechanism on the way of jointing the male and female connectors.

Turning the lever 4 in the initial jointing of FIG. 6, the front end of the fin portion 6 extending downward from the lever 4 pushes down the projection 28 at a rear end of the second locking arm 9 on the way of jointing the connectors, as shown in FIG. 7. Thereby, the rear half portion of the second locking arm 9 turns downward around the post portion 27 (supporting portion) as a fulcrum, and the front half portion thereof turns upward along an arrow B, and then the locking portion 31 at a front side of the arm goes over the engaging projection 31 of the female connector 29 without contacting or with contacting slightly to the slant portion.

Therefore, collision between the second locking arm 9 and the engaging projection 30 as usual is not occurred and operating force for jointing connectors can be reduced to improve operatability of jointing. While turning the lever 4, the slant surface 6*a* at a front side of the fin portion 6 can slide smoothly on the rear end of the second locking arm 9 so that turning the lever 4 and turning the second locking arm 9 can be done smoothly without sticking.

Thus, the lever 4 and the second locking arm 9 move synchronously (by interlocking) with the same timing. With turning the lever 4, the cam groove 13 (FIG. 1) of the lever 4 engages slidably with the follower shaft 36 (FIG. 9) of the female connector 29, and the female connector 29 is guided in a direction of jointing with the male connector 1.

Turning the lever 4 furthermore in a condition of FIG. 7, the fin portion 6 of the lever 4 moves to forward of the projection 28 of the second locking arm 9, and goes into the groove 33 at the widthwise center of the second locking arm 9. Simultaneously, the second locking arm 9 restores elastically to turn the projection 28 upward and the locking portion 31 downward. Thereby, the engaging projection 30 of the female connector 29 goes into the room 32 of a front half of the second locking arm 9, and the locking surface at a rear end of the locking portion 31 abuts on the vertical surface at a rear end of the engaging projection 30. Then, the male and female connectors are locked mutually and prevented from separating.

Figure 8:
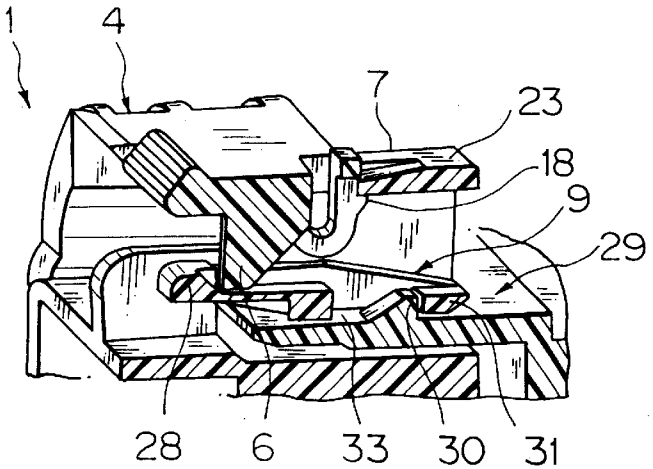
FIG. 8 is a perspective view, showing a main area of the locking mechanism when completely jointing the male and female connectors.

Simultaneously, the first locking arm 5, positioning backward of the frame wall 7 on the way of turning in FIG. 7, engages with the frame wall 7 in FIG. 8 and the lever 4 is locked with the frame wall 7 to prevent play of the lever 4. When locking, the locking projection 18 of the first locking arm 5 slides on the rear end of the frame wall 7 and the first locking arm 5 deflects rearward, and the locking projection 18 goes over the top wall 23 of the frame wall 7 downwardly in a direction of width thereof, and simultaneously, the first locking arm 5 restores elastically to engage the locking projection 18 with the bottom surface of the top wall 23.

The fin portion 6 of the lever 4 goes into and engages with the groove 3 of the second locking arm 9 to position the second locking arm 9 widthwise and then the second locking arm 9 and the fin portion 6 are positioned and maintained securely.

To separate the both connectors 1, 29 in completely jointed (locked) condition of FIG. 8, pushing a free end of the first locking arm 5 integrated with the lever 4 toward deflecting (pulling backward the lever 4) by a finger, the locking projection 18 is removed from the frame wall 7 to unlock the lever 4, and the operating plate portion 17 of the lever 4 is be-pushed backward (pulled) and turned by the same finger as shown in FIG. 7.

Thereby, the fin portion 6 of the lever 4 pushes down the projection 28 at the rear end of the second locking arm 9 in the housing body as shown in FIG. 7, and the second locking arm 9 turns around the post portion 27 as a fulcrum, and the locking portion 31 at the front end of the second locking arm 9 is move upward to remove from the engaging projection 30 of the mating female connector 29. Thus, the jointed connectors are unlocked. In this unlocked condition, pulling the both connectors 1, 29 in a direction for separating, jointing of the both connectors 1, 29 is released, as shown in FIG. 6.

The first locking arm 5 is integrally formed adjacently to the operation plate portion 17 of the lever 4 so that unlocking the first locking arm 5 and turning the lever 4 for unlocking (rearward) can be done simultaneously by the same finger. Therefore, operatability for separating the jointed connectors 1, 29 and unlocking is improved. The fin portion 6 enters slidably into the groove 33 of the second locking arm 9 so that the fin portion 6 is securely guided along the groove 33 to the be-pushed projection 28 without positioning error and then pushing the projection 28, i.e. unlocking, can be done securely.

Figure 9:
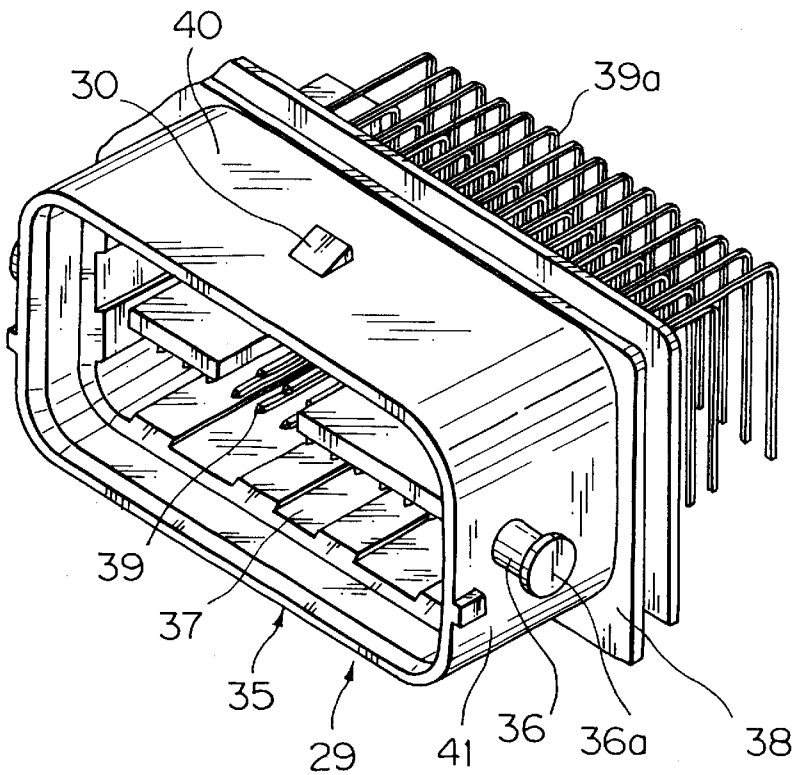
FIG. 9 is a perspective view of one embodiment of a female connector in a lever-joint connector according to this invention.

FIG. 9 shows an embodiment of a female connector according to this invention. The female connector 29 includes a connector housing 35 having a connector receiving section 37 surrounded by means of up/down and right/left walls, a vertical basic wall 38 at rear side, and a pin-type male terminal 39 projecting inside the connector receiving section 37 through the basic wall 38. A rear portion 39*a* of the terminal 39 is bent downward and soldered with a not-shown circuit board. The female connector 29 may performs as a connector to be mounted directly on equipment.

An engaging projection 30 corresponding to the locking portion 31 (FIG. 8) at a front end of the second locking arm 9 is formed integrally on a top wall 40 of the connector housing 35. The engaging projection 31 has a slant surface at a front side thereof and a vertical locking surface at a rear side thereof. Short cylindrical shape follower shafts 36 for engaging slidably with the cam opening 13 (FIG. 1) of the lever 4 project outward from both side walls 41 of the connector housing 35. The follower shaft 36 has a larger diameter disk head 36*a* on the top thereof.

FIG. 10 shows a condition of initial slightly jointing the male and female connectors by a finger (omitting terminals and electric wires in the drawing), corresponding to FIG. 6. The lever 4 is located tilting backward the male connector 1. The shaft 14 of the male connector 1 engage with the opening 16 at a rear side of the lever 4 and the follower shaft 36 of the female connector 29 engages with the front end of the cam opening 13 at a front side of the lever 4. The second locking arm 9 is located inside the frame wall 7 at the top side of the male connector 1, and the engaging projection 30 (FIG. 6) of the female connector 29 is located slightly froward the locking arm 9.

Turning froward the lever 4 in a condition of FIG. 10, the cam opening 13 tilting the front thereof down in FIG. 10 turns downward around the shaft 14 at the rear side thereof. The follower shaft 36 of the female connector 29 slides relatively from one end to the other end (upper end in FIG. 11) of the cam opening 13 to be pulled in a direction of jointing connectors. Thereby, the male and female connectors 1, 29 are jointed completely as shown in FIG. 11.

Figure 11:
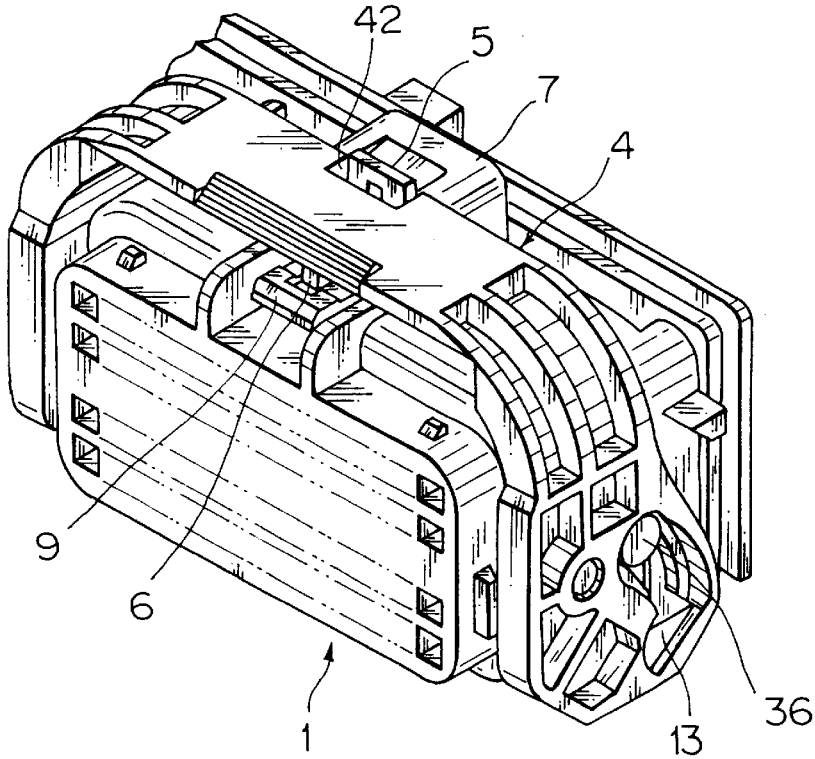
FIG. 11 is a perspective view, showing a condition of completely jointing the male and female connectors.
Figure 12:
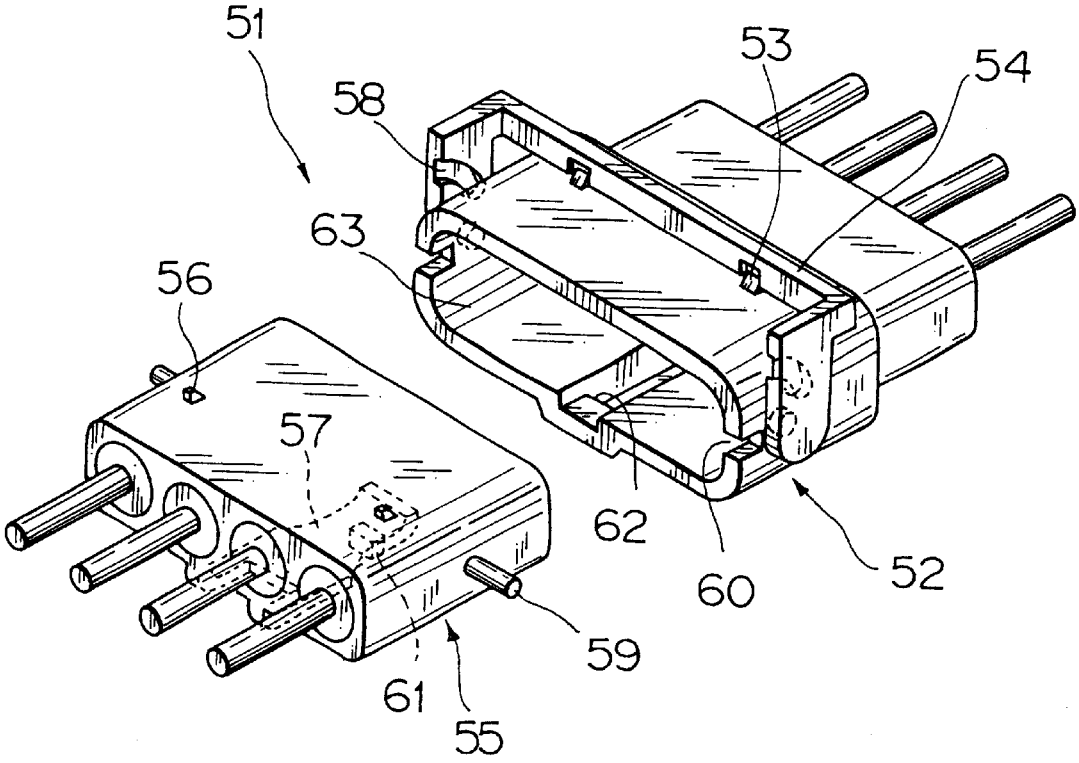
FIG. 12 PRIOR ART
FIG. 12 is an exploded perspective view of one embodiment of a lever-joint connector by prior art.

FIG. 11 shows a condition of complete jointing the male and female connectors, corresponding to FIG. 8. The lever 4 stands vertically, and the first locking arm 5 of the lever 4 is locked by means of the frame wall 7 of the male connector 1. The second locking arm 9 of the male connector 1 rocks up and down by means of pushing action of the fin portion 6 of the lever 4, and is locked by the engaging projection 30 of the female connector 29.

The front end (top end) of first locking arm 5 is in a rectangular cutout portion 42 of the lever 4 to have a room for deflecting between a rear end surface of the cutout portion 42 and a rear surface of the first locking arm 5. When unlocking, pulling the front end (remarking 5 in FIG. 11) of the first locking arm 5 backward, the lever 4 can be turned backward to keep the front end abutting on the rear end surface of the cutout portion 42 so that unlocking is good operational. The fin portion 6 is positioned in the groove 33 of the second locking arm 9. The second locking arm 9 is located inside between the lever 4 and the frame wall 7 to be protected from outer action.

As other than above embodiment, the lever 4 may have a cam groove instead of the cam opening 13, or the female connector instead of the male connector may have the lever 4, the first and second locking arm 5, 9 and the frame wall 7 for locking. In this case, the hood 3 of the male connector 1 corresponds to an outer wall of the female connector and the male connector without a hood is used. Furthermore, an L-shape wall or a horizontal wall including an engaging wall corresponding to the locking projection 18 of the first locking arm 5 may be provided instead of the frame wall 7.

The fin portion 6 can have not only triangle or trapezoid shape, but also rectangular, arc, columnar or projecting shape. A slant surface for guiding may be formed at a rear end of the be-pushed projection 28 of the second locking arm instead of a front end of the fin portion 6. The second locking arm 9 may be supported at the both sides thereof, if the locking portion at a front end is energized downward, i.e. in a direction for locking, and the second locking arm 9 can rock like a teeter-totter. A locking concave portion can be formed instead of the locking projection 18 of the first locking arm 5 and a locking projection engaging with the locking concave portion can be formed at a top wall of the frame wall 7. A locking projection may be used instead of the locking portion 31 of the second locking arm 9 and an engaging concave portion or an engaging opening can be used instead of the engaging projection 30 corresponding to the locking portion 31.

While the forms of the invention herein disclosed constitute presently preferred embodiments, many others are possible. It is not intended herein to mention all the possible embodiments of the invention which will be apparent to those skilled in the art. It is understood that the term used herein are merely descriptive rather than limiting, in that various changes may be made without departing from the spirit or scope of this invention as defined by the following claims.

What is claimed is:

1. A lever-joint connector, comprising:

one half of the connector being provided with a freely rotatable lever; and the other half of the connector being provided with a follower portion to be engaged slidably with the lever, whereby said lever includes a first locking portion and a pushing portion, whereby said one half of the connector includes a first be-locked portion to be locked by the first locking portion, and a second locking portion having a be-pushed portion to be pushed by the pushing portion, and said other half of the connector includes a second be-locked portion to be locked by the second locking portion, wherein the pushing portion pushes said be-pushed portion during the turn of the lever to turn the second locking portion in a direction of unlocking it from the locking with the second be-locked portion.

2. The lever-joint connector according to claim 1, further comprising an insert portion, for inserting the pushing portion, adjacently to the be-pushed portion, into the second locking portion.

3. The lever-joint connector according to claim 1 or 2, wherein said first locking portion is a flexible first locking arm mounted at a front end of the lever.

4. The lever-joint connector according to claim 1 or 2, wherein said second locking portion is a teeter type second locking arm, and having a locking portion corresponding to the second be-locked portion at a front end thereof, and that be-pushed portion at a rear end thereof, whereby the second locking arm is energized at a front thereof downward in a free condition.

5. The lever-joint connector according to claim 1 or 2, wherein said pushing portion is a plate-like fin portion extending downward from the lever, wherein said insert portion for the pushing portion is a groove along lengthwise of the second locking portion.

6. The lever-joint connector according to claim 1 or 2, wherein the pushing portion is located behind the first locking portion and on an axis of the widthwise center line of the first locking portion.

7. The lever-joint connector according to claim 1 or 2, wherein said second locking portion is located inside a frame-like wall which constitutes the first be-locked portion.

* * * * *